United States Patent [19]

Sable

[11] Patent Number: 4,575,163

[45] Date of Patent: Mar. 11, 1986

[54] ROD GUIDE

[76] Inventor: Donald E. Sable, 4301 Edmondson, Dallas, Tex. 75205-2601

[21] Appl. No.: 687,830

[22] Filed: Dec. 31, 1984

[51] Int. Cl.[4] ..... F16C 29/02

[52] U.S. Cl. ..... 308/4 A; 166/241

[58] Field of Search ..... 308/4 A, 4 R, 3 R; 166/241

[56] References Cited

U.S. PATENT DOCUMENTS 3,414,337 12/1968 Sable ..... 308/4 A 3,442,558 6/1969 Sable ..... 308/4 A 3,650,579 3/1972 Sable ..... 308/4 A 4,441,565 4/1984 Liljekvist ..... 308/4 A

*Primary Examiner*—Lenard A. Footland

[57] ABSTRACT

A guide for a sucker rod employed to actuate a pump connected in the tubing of a well whose body is formed of a resilient substance and adapted to resiliently grip the rod, the body having cam surfaces engageable with the rod for facilitating the mounting of the guide on the rod and arcuate internal stop surfaces at its opposite ends of substantially the same conformation as the surfaces of the enlargements or upsets at the opposite ends of the rod which the guide may engage if displaced on the rod as by contact with an internal obstruction in the tubing.

2 Claims, 3 Drawing Figures

ROD GUIDE

This invention relates to well tools and more particularly to well tools mountable on rods.

BACKGROUND OF THE INVENTION

As disclosed in U.S. Pat. Nos. 3,442,558, 3,414,337 and 3,650,579, rod guides formed of a resilient substance have long been in use to hold the rods of a sucker rod string, whose reciprocal movement in the tubing of a well actuates a pump connected in the tubing, in centralized position in the tubing. Such rod guides have a central longitudinal bore of somewhat smaller diameter than the diameter of the rods on which they are mountable in order that the guides grip the rods and tend to hold the rods with considerable force against relative longitudinal movement therebetween.

Such guides also have mounting slots having top and bottom longitudinal sections opening radially from the central bore in opposite directions and a transverse section joining the longitudinal sections so that the guides may be mounted on the rods by moving the guides onto the rods with the transverse sections of the mounting slots receiving the rods and then rotating the guides about axes perpendicular to the longitudinal axes of the rods as the longitudinal sections receive the rod, the portions of the guides on opposite sides of the longitudinal sections displacing outwardly to enable such movement of the guides until the longitudinal bores of the guides receive the rods and the guides resiliently grip the rods.

It has been found that some damage may be caused to the guides at the initiation of such rotation of the guides at the locations of contact of the surfaces of the longitudinal sections of the guide with the rods. In addition, if the end surfaces of the guides are perpendicular to their longitudinal axes, the rod guides may be expanded and forced off the rods due to the camming action of the arcuately outwardly extending surfaces of the upsets at the opposite ends of the rods if the guides are held against longitudinal movement in the tubing by engagement with an internal surface of the tubing while the rod is moved longitudinally relative thereto with a force greater than that which may cause such expansion.

OBJECTS OF THE INVENTION

Accordingly, it is an object of this invention to provide a new and improved well tool resiliently mountable on a rod.

Another object is to provide a well tool, such as a rod guide or centralizer, which is mountable on a rod and held thereon by the resilient force of the substance of which the rod is made.

An important object is to provide a rod guide formed of a resilient substance having a central longitudinal bore of slightly smaller diameter than the diameter of the rod on which it is to be mounted and a mounting slot opening outwardly of the longitudinal central bore and having top and bottom longitudinal radially oppositely opening sections and a transverse section extending between and opening to the inner ends of the longitudinal sections, wherein the guide has pairs of externally extending convergently inwardly from the external surface of the guide cam surfaces at the inner ends of the longitudinal sections engageable with the rod for facilitating movement of the guide relative to the rod toward longitudinally aligned mounted position thereon.

Still another object is to provide a rod guide, of the type described, having at its opposite ends internal arcuate outwardly curving surfaces engageable with similarly arcuate facing surfaces of the upsets of the rod for minimizing any force tending to cause expansion of the guide by camming action of such co-engageable surfaces of the guide and of the rod.

SUMMARY OF THE INVENTION

A rod guide made of a resilient substance having a central longitudinal bore and a mounting slot comprising top and bottom longitudinal sections and a transverse section between and opening to the inner ends of the longitudinal sections, the guide having pairs of divergently outwardly extending cam surfaces at the inner ends of the longitudinal slots engageable with the rod for facilitating installation of the guide on the rod by flexing portions of the guide on opposite sides of the longitudinal sections outwardly as the guide is rotated onto the rod. The guide also has arcuate internal outwardly and longitudinally curving stop surfaces at its opposite ends engageable with the similarly arcuate facing surfaces of the upsets at the ends of the rod.

BRIEF DESCRIPTION OF THE DRAWINGS

Additional objects and advantages of the invention will become apparent from the reading of the following description of a device constructed in accordance with the invention and references to the accompanying drawings thereof, wherein.

Figure 1:
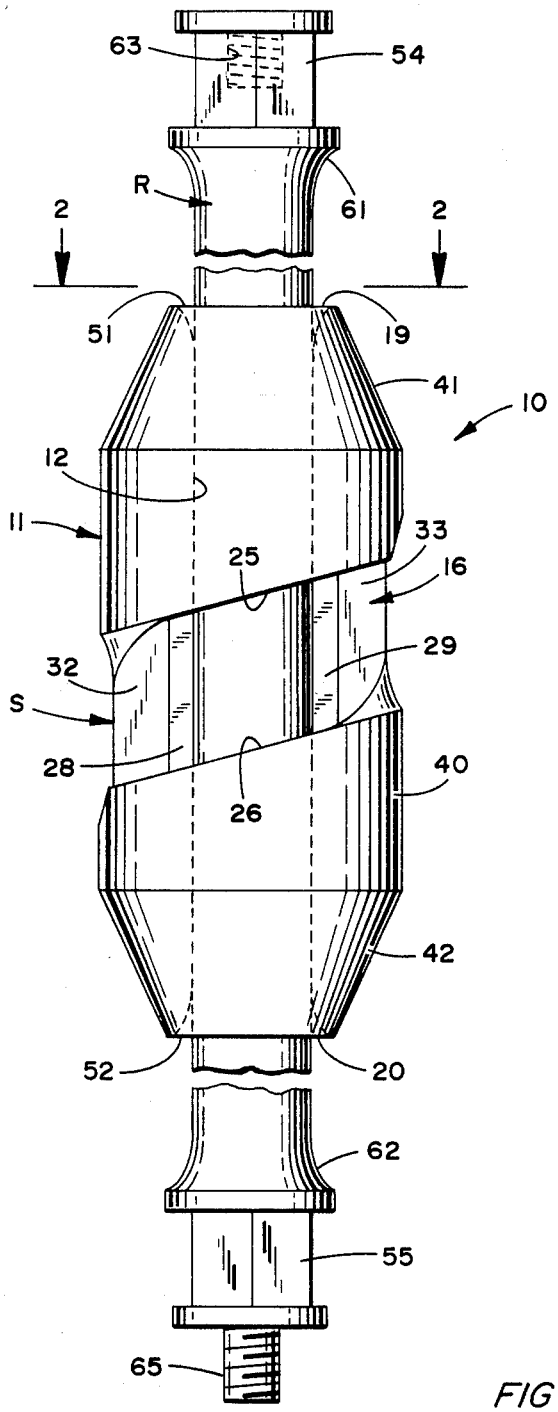
FIG. 1 is a plan view of the rod guide embodying the invention showing it mounted on a rod.
Figure 2:
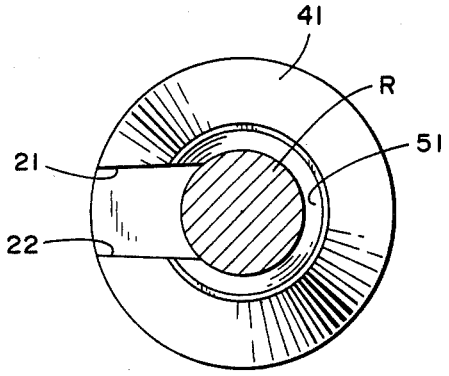
FIG. 2 is a cross-sectional view taken on line 2—2 of FIG. 1.

Referring now to the drawing, the guide 10 embodying the invention is mountable on a sucker rod R which is reciprocally movable in a well flow conductor such as a string of tubing to actuate a pump which moves well fluids to the surface through the flow conductor.

The guide comprises a tubular body 11 of a somewhat resilient substance such as rubber, nylon and the like and has a central longitudinal bore 12, of a diameter slightly smaller than the diameter of the sucker rod R, and a mounting slot S which opens outwardly from the central bore to the external surface of the body to permit mounting of the body on the rod.

The mounting slot has top and bottom longitudinal sections 14 and 15, which extend radially outwardly in opposite directions from the central bore, and a transverse section 16. The longitudinal sections 14 and 15 open to the transverse slot at radially opposite and longitudinally spaced locations and extend to the opposite end surfaces 19 and 20, respectively, of the body 11.

The top section 14 of the mounting slot is defined by the longitudinal surfaces 21 and 22 of the body which extend divergently inwardly from the outer surface of the body and the bottom section 15 thereof is similarly defined by the longitudinal surfaces 23 and 24 which extend divergently inwardly from the outer surface of the body.

The transverse section 16 of the slot S is defined by the facing parallel surfaces 25 and 26 which extend angularly relatively to the central longitudinal axis of the body. The inner ends of the longitudinal sections 14 and 15 of the slot S open to opposite ends of the transverse section 16.

The inner end of the transverse section 16 of the slot is defined by the longitudinal surfaces 28 and 29 of the intermediate portion 30 of the body of reduced thickness which also has longitudinal surfaces 32 and 33 which extend divergently outwardly from its longitudinal surfaces 28 and 29, respectively.

The reduced thickness of the intermediate portion 30 of the body facilitates the installations of the guide on a rod by permitting some flexure of opposite end portions of the body as will be explained below.

The body 11 has as a middle cylindrical outer surface 40 and beveled surfaces or shoulders 41 and 42 extending convergently from the top and bottom ends of the cylindrical surface to the end surfaces 19 and 20, respectively, of the body. The planar end surfaces 19 and 20 lie in parallel planes extending perpendicular to the central longitudinal axis of the body.

In order to facilitate the installation of the body on the rod, the body is provided with cam surfaces 43 and 44 which extend longitudinally convergently from the cylindrical surface 40 to surfaces 21 and 22, respectively, inwardly and also radially downwardly inwardly from the cylindrical surface 40 to the top downwardly facing surface 25 defining the top of the transverse slot section at the upper end thereof. Similarly, at the lower end of the transverse slot section, the body 11 is provided with cam surfaces 46 and 47 which extend longitudinally convergently inwardly and upwardly from the cylindrical surface 40 to the bottom upwardly facing surface 26 defining the transverse slot section and also convergently radially inwardly to the surfaces 23 and 24.

The pairs of cam surfaces 43 and 44 and 46 and 47 engage the rod during the installation of the guide on the rod and assist in directing movement of the guide body onto the rod and also in causing resilient flexure of the portions of the body above and below the transverse slot section in opposite directions away from the surfaces 22 and 24, respectively, defining the upper and lower longitudinal slot sections 14 and 15.

The central longitudinal bore 12 of the guide body is enlarged at its opposite end portions to provide the top and bottom stop surfaces 51 and 52, the top stop surface curving upwardly and outwardly to the body top end surface 19, and the bottom stop surface curving downwardly and outwardly to the body bottom end surface 20.

The stop surfaces 51 and 52 have substantially the same dimensions and configuration as the arcuate surfaces 61 and 62 of the usual upsets at the opposite ends of the rod. The opposite ends of the rod are provided with tool portions 54 and 55, square in cross sections, which provide opposed pairs of parallel surfaces engageable by tools. The top tool portion box half of a tool joint is provided with a threaded socket 63 and the other bottom portion being the pin half of a tool joint being provided with a threaded pin 65. It will be well known to those skilled in the art that a plurality of such rods are connected to form the sucker rod string, the pin of one rod being threaded in the socket of the next lower rod.

Figure 3:
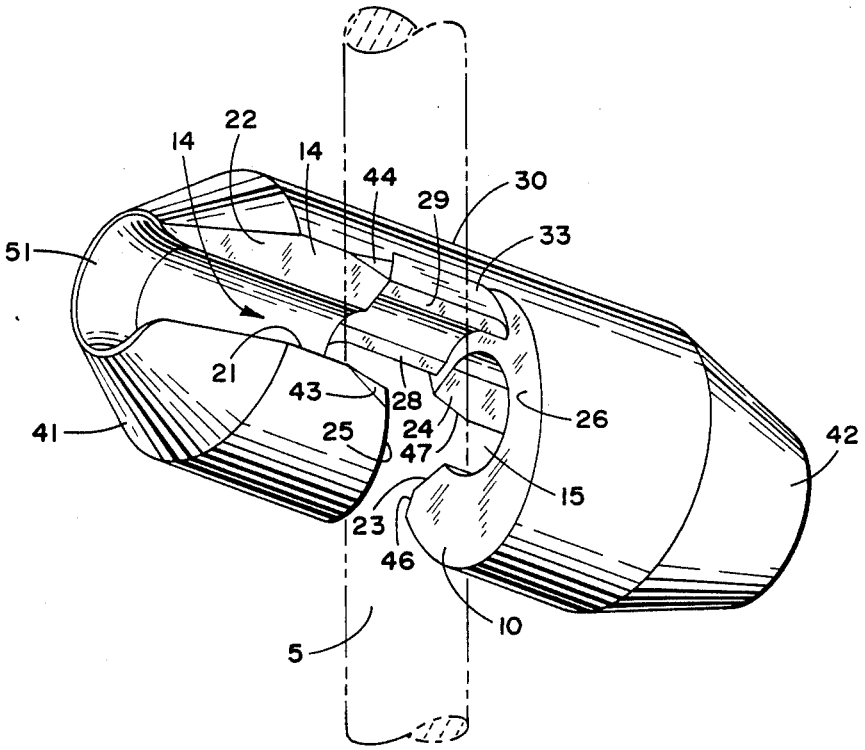
FIG. 3 is a view showing the manner in which the rod guide is installed on the rod guide.

In use, the rod guides are mounted on those rods of a sucker or pump rod string which are to reciprocate in portions of the tubing which are not straight. To install a rod guide on a rod, the guide is placed on the rod by moving the transverse portion of the mounting slot S on and about the rod with the longitudinal slot sections aligned with the rod. The guide is then rotated about an axis perpendicular to the longitudinal axis of the rod, in a clockwise direction as seen in FIG. 3, so that the pairs of cam surfaces 43 and 44 and 46 and 47 contact the rod at opposed locations along the rod.

As force is exerted on the guide by a suitable tool tending to rotate it about such axis in clockwise manner, the pairs of cam surfaces direct the guide into proper alignment with the rod so that the guide is forced to rotate and move to positions wherein its longitudinal bore receives and is aligned on the rod. The cam surfaces also tend to flex opposed portions of the guide, above and below the slot transverse section and spaced from the intermediate body portion, to permit such movement of the guide onto the rod.

Since the diameter of the body bore 12 is somewhat smaller than the diameter of the rod, the guide now resiliently grips or holds the rod and is held stationary thereon.

If, during the reciprocation of the rod in the tubing, the guide engages an internal obstruction in the tubing and is held against movement with the rod, the rod may forcibly slide through the guide bore until arcuate surfaces of an upset of the rod engages the stop surface of the guide. For example, if the rod is moving downward and the guide is held against downward movement, the rod arcuate surface 61 will engage the top stop surface 51 and prevent further downward movement of the rod relative to the guide. If sufficient downward force is now applied by the rod string, the guide may be moved forcibly downwardly past such obstruction the cam surface 42 aiding such downward movement past such obstruction. Conversely, during upward movement of the rod if the guide engages an internal obstruction which holds it against upward movement with a force which exceeds the force with which the guide holds the rod against longitudinal movement relative thereto the rod will move upwardly through the guide until the bottom arcuate surface 62 of the rod engages the bottom stop surface 52 of the rod. If sufficient upward force is now applied by the rod string, the guide may be moved forcibly upwardly past such obstruction.

If conventional rod guides, such as disclosed in the above referenced U.S. Letters Patent, engage an internal obstruction of the tubing and are restrained against longitudinal movement therepast by a force greater than that which holds the guide against movement relative to the rod, the rod will move longitudinally relative to and through the rod until, for example, if the guide is held against downward movement, the inner edge of the top planar end surface of the guide is engaged by the arcuate upset surface. As further downward movement of the rod continues the arcuate surfaces cause the upper portions of the guide to flex outwardly from the intermediate portions and cause the guide to be forced off the rod, the rod then passing through the longitudinal sections as the guide rotates about an axis perpendicular to the longitudinal axis of the rod.

It will be apparent that once the guide is forced off the rod, not only will the rod not be held in proper centralized position in the tubing, but the guide itself will now interfere with the rod movement and obstruct proper flow of the pumped well fluids through the tubing.

It will now be seen that a new and improved rod guide has been illustrated and described which has cam means, the pairs of cam surfaces 23 and 24 and 43 and 44 for facilitating installation of the guide in the rod and stop surfaces, the arcuate surfaces 51 and 52 which are engageable with the arcuate surfaces 61 and 62, respectively, of the upsets of the rod to prevent movement of the rod relative to the guide upon engagement therewith, such engagement of a stop surface with its facing arcuate surface 61 or 62 of the rod not providing a cam or vector force which would tend to expand the guide and force it off the rod.

The foregoing description of the invention is explanatory only and changes in the details of the construction illustrated may be made by those skilled in the art within the scope of the appended claims without departing from the invention.

What is claimed and desired to be secured by Letters Patent is:

1. A guide for a sucker rod comprising: a resilient body having a central longitudinal bore and a mounting slot therethrough opening to said bore, said slot having two longitudinal sections opening to the exterior of said body in mutually opposite radial directions, said slot having a transverse section joining said longitudinal sections wherein said body at one end of said slot transverse section having cam surfaces on opposite sides of the inner end of said top longitudinal slot section extending longitudinally upwardly and outwardly from a first top surface of the body defining the top of said slot transverse section and convergently inwardly from said cylindrical surface, said body at the other end of said slot transverse section has cam surfaces on opposite sides of the inner end of said bottom longitudinal slot section extending longitudinally downwardly and outwardly from a second surface of the body defining the bottom of said slot transverse section and convergently inwardly from said cylindrical surface, whereby said cam surfaces guide movement of said guide body onto a rod during rotational movement of the body about an axis perpendicular to the longitudinal axis of the rod to position said guide body on the rod with the rod extending through said bore.

2. A guide for a sucker rod comprising: a resilient body having a central longitudinal bore and a mounting slot therethrough opening to said bore, said slot having two longitudinal sections opening to the exterior of said body in mutually opposite radial directions, said slot having a transverse section joining said longitudinal sections, said bore of said guide at its top and bottom portions increasing progressively in diameter to provide arcuately radially and longitudinally outwardly curving stop surfaces engageable by similarly curving arcuate surfaces of the upsets of a rod on which said guide is mountable whereby longitudinal movement of the rod relative to the guide is arrested upon engagement of a stop surface with the arcuate surface of an upset of the rod, said guide body having a middle portion having a substantially cylindrical outer surface, said guide body having external top and bottom surfaces extending longitudinally outwardly and radially inwardly from opposite ends of said substantially cylindrical surface, said body at one end of said slot transverse section having cam surfaces on opposite sides of the inner end of said top longitudinal slot section extending longitudinally upwardly and outwardly from a first top surface of the body defining the top of said slot transverse section and convergently inwardly from said cylindrical surface, said body at the other end of said slot transverse section having cam surfaces on opposite sides of the inner end of said bottom longitudinal slot section extending longitudinally downwardly and outwardly from a second surface of the body defining the bottom of said slot transverse section and convergently inwardly from said cylindrical surface, whereby said cam surfaces guide movement of said guide body onto a rod during rotational movement of the body about an axis perpendicular to the longitudinal axis of the rod to position said guide body on the rod with the rod extending through said bore.

* * * * *